United States Patent [19]

Nelson et al.

[11] 4,110,758

[45] Aug. 29, 1978

[54] HIGH QUALITY PRINTING SYSTEM WITH CONSTANT INTERMITTENT TAPE DRIVE

[75] Inventors: Alfred N. Nelson; David L. Davis, both of Los Angeles, Calif.

[73] Assignee: Addressograph Multigraph Corporation, Los Angeles, Calif.

[21] Appl. No.: 753,440

[22] Filed: Dec. 22, 1976

[51] Int. Cl.[2] ..... G03G 19/00; B65H 17/42

[52] U.S. Cl. ..... 346/74.1; 226/113; 226/118; 226/170; 242/182

[58] Field of Search ..... 346/74.1; 242/182, 183–185; 226/95, 97, 113, 118, 170

[56] References Cited

U.S. PATENT DOCUMENTS

| | | | |
|---|---|---|---|
| 2,775,447 | 12/1956 | Stirn | 226/170 |
| 2,979,244 | 4/1961 | Pouliart | 226/170 |
| 3,254,626 | 6/1966 | Uemura | 346/74.1 |
| 3,549,104 | 12/1970 | Morrow | 226/170 |
| 3,589,579 | 6/1971 | Schulz | 226/118 |
| 3,767,097 | 10/1973 | Watts | 226/113 |
| 3,805,407 | 4/1974 | Fleissner | 226/118 |
| 3,958,777 | 5/1976 | Gervais | 242/182 |

*Primary Examiner*—Jay P. Lucas
*Attorney, Agent, or Firm*—Robert S. Hulse; Ray S. Pyle

[57] ABSTRACT

A printing system of the type wherein magnetic images are recorded on a tape, the images are toned, the tape is positioned to extend adjacent to a web of paper, and the toner is then transferred from the tape to the paper. In the present system, the tape portion which passes by the image recording head and toner is moved continuously, while the tape portion which passes adjacent to the paper is moved intermittently by frictional engagement with a transport belt, a pair of vacuum column buffers being provided between the continuously and intermittently driven tape portions and supplying tape tension that holds the tape to the transport belt. At the transfer station where the tape extends adjacent to the paper, transfer is effected by stopping the tape, and then utilizing a pair of actuators on either side of the paper to move corresponding tape locations to the plane of the paper, so that all portions of the tape contact or are very close to the paper, and by then applying a high voltage pulse to transfer the toner from the tape to the paper.

11 Claims, 7 Drawing Figures

Fig. 4
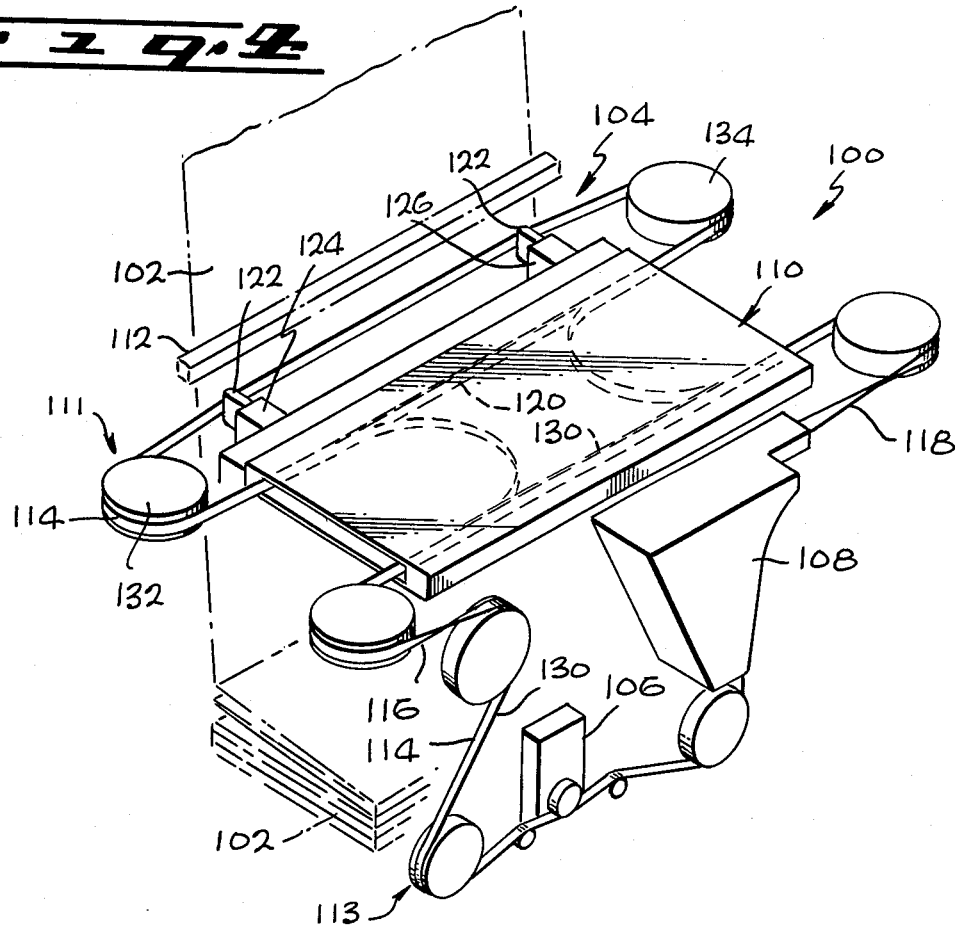
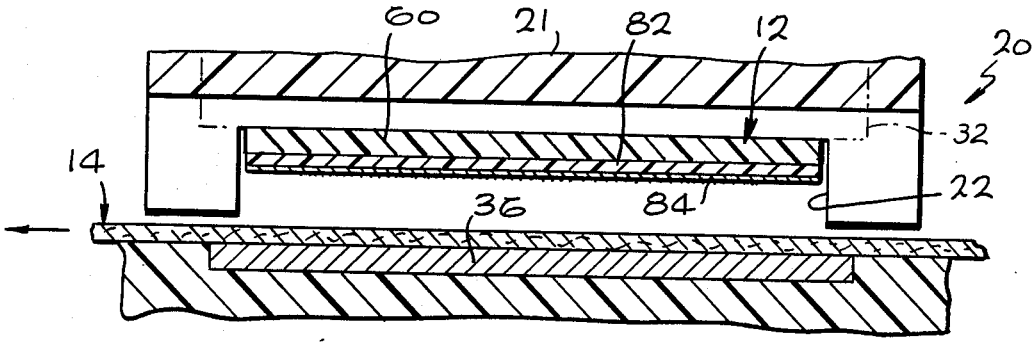
Fig. 3

HIGH QUALITY PRINTING SYSTEM WITH CONSTANT INTERMITTENT TAPE DRIVE

BACKGROUND OF THE INVENTION

One printing system, described in U.S. patent application, Ser. No. 631,329, filed Nov. 12, 1975, by Alfred M. Nelson now abandoned, utilizes a head for recording magnetic images on the front face of a magnetic tape, apparatus for coating the images with toner, and a transfer station which transfers the toner on the tape to paper or other print medium.

In the system described therein, the tape moves continuously across the paper, while a small air gap is maintained between the tape and paper. Toner is transferred from the moving tape to the paper by a brief high voltage pulse applied between electrodes located respectively behind the tape and paper.

In utilizing the above-described system, it has been found that, although characters of detail can be printed, the characters have "fuzzy" edges which is believed due to toner particles spreading apart while traversing the gap. In some applications, it is necessary to provide very high quality characters with sharply defined edges.

SUMMARY OF THE INVENTION

In accordance with one embodiment of the present invention, a printing apparatus is provided of the type which utilizes toned magnetic images on a tape or the like which are transferred to a paper or other print medium, wherein the printing apparatus can produce printing on the print medium without substantial background, or loss of edge accuity. This can be accomplished by a system which includes a transport that momentarily stops the tape portion which lies adjacent to the paper, a pair of actuators that press the two tape portions lying opposite the margins of the paper against the paper, margins or an adjacent region, and electrodes that apply a brief electrostatic field that transfers the toner from the tape to the paper. The magnetizeable layer on the tape is formed of metal, rather than the more usual oxide materials, and the metal layer is grounded to effect a more complete transfer of toner to the paper.

The movement of the magnetic tape is accomplished by two belt transports, including a continuously moving belt transport which moves the tape past a recording head and toner applying device, and an intermittent belt transport which moves the tape to a position opposite the paper or other print medium and pauses briefly while toner transfer is effected. A pair of buffers such as vacuum column buffers, are utilized between the two belt transports.

The novel features of the invention are set forth with particularity in the appended claims. The invention will be best understood from the following description when read in conjunction with the accompanying drawings.

BRIEF DESCRIPTION OF THE DRAWINGS

FIG. 3 is a view taken on the line 3—3 of FIG. 1;

FIG. 4 is a partial perspective view of a printing system constructed in accordance with another embodiment of the invention;

DESCRIPTION OF THE PREFERRED EMBODIMENT

Figures 1, 2:
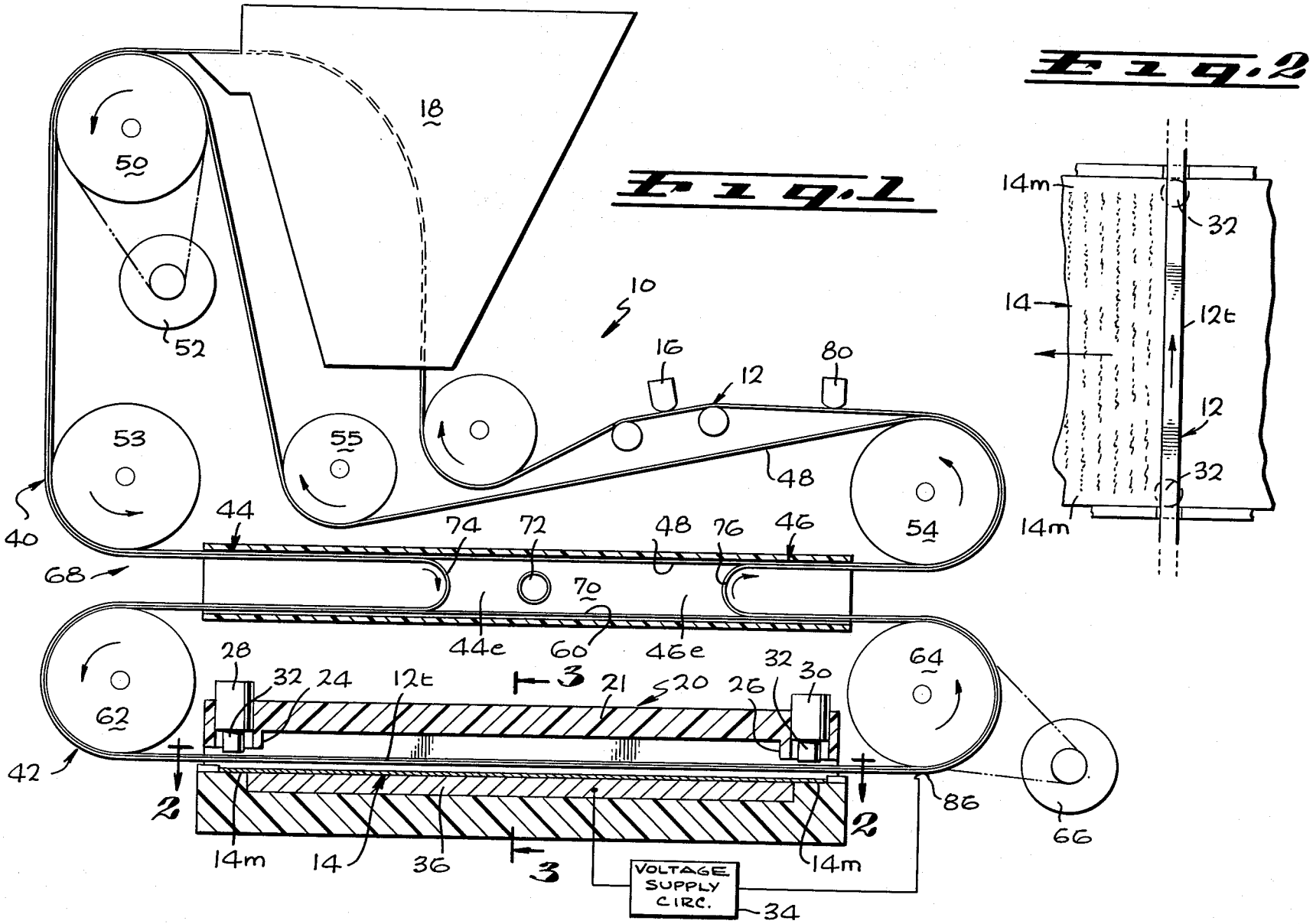
FIG. 1 is a simplified end elevation and cross-sectional view of a printing system constructed in accordance with one embodiment of the present invention.
FIG. 2 is a view taken on the line 2—2 of FIG. 1.
Figure 5:
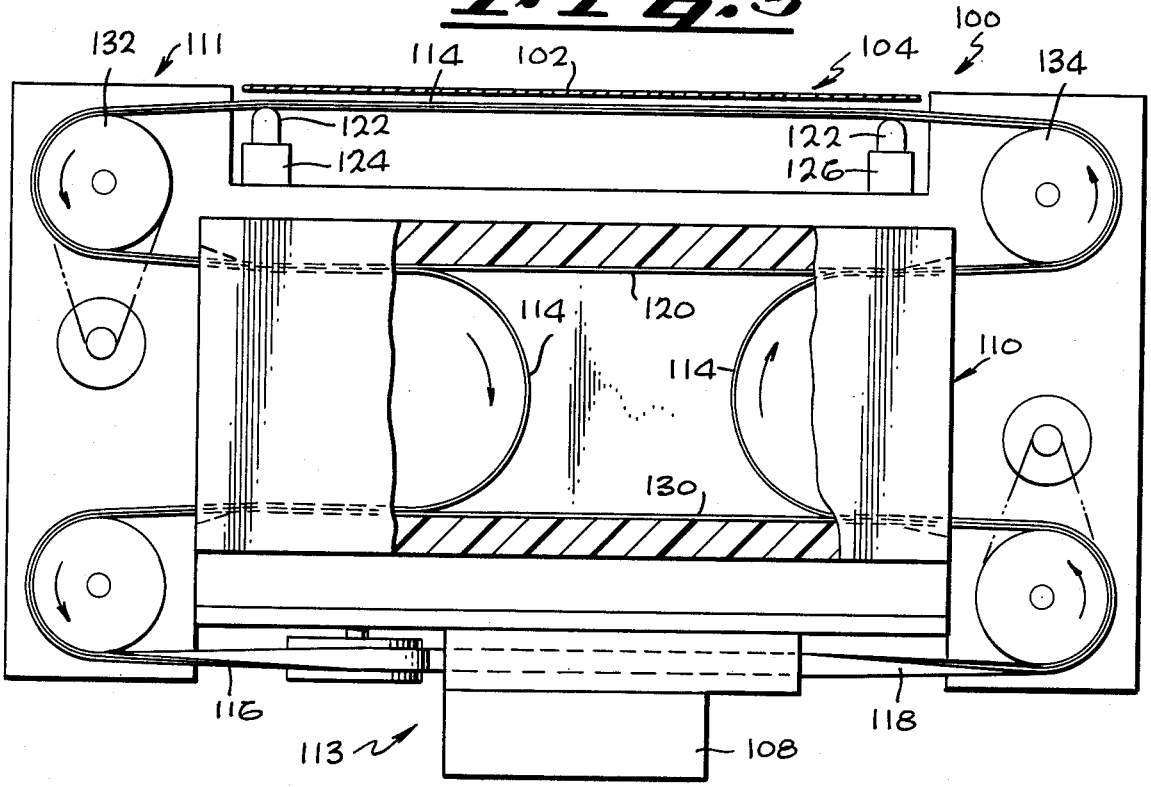
FIG. 5 is a plan view of the system of FIG. 4.
Figure 6:
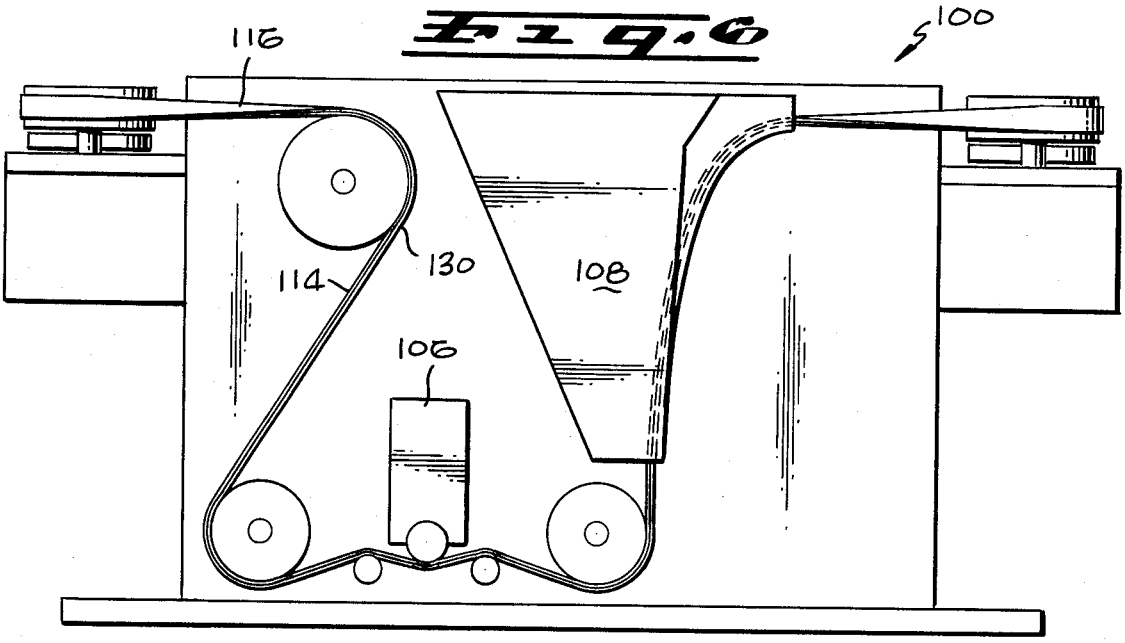
FIG. 6 is a rear elevation view of the system of FIG. 4.
Figure 7:
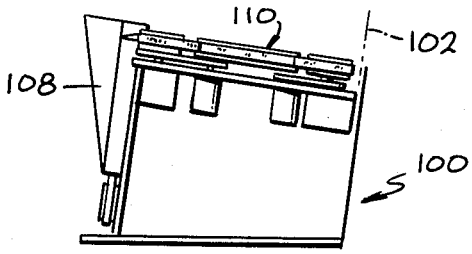
FIG. 7 is a partial side elevation view of the system of FIG. 4.

FIG. 1 illustrates a printing system 10, which utilizes a magnetic tape 12 that extends in a continuous loop, and which prints alphanumeric characters or the like onto a print medium 14 which may be a wide strip of paper. The magnetic tape 12 moves past a recording head 16, where magnetic images are recorded on the tape, past a toner device 18, where toner is applied to the magnetic images, and to a transfer station 20 where toner on the tape is transferred to the paper or other print medium 14. Normally, toner representing an entire line of characters is transferred at one time from the tape to the paper 14. The paper 14 is then moved in a direction out of the drawing of FIG. 1, so that a next line of characters can be printed thereon.

At the transfer station 20, the tape 12 passes under a frame 21 with guides 24, 26 at its ends, and passes through grooves 22 in the guides. The guides 24, 26 lie opposite the edge or margin portions **14*m* of the paper strip, and the tape portions passing through the guides lie under a pair of actuators 28, 30. When a length of tape 12*t* carrying toner that represents an entire line of type, moves to a position opposite the paper 14, the tape suddenly stops. The two actuators 28, 30 are then activated so that their plungers 32 move against the opposite ends of the tape portion 12*t*, and press them against the margin regions 14*m* of the paper print medium. At the instant that the opposite ends of the tape portion 12*t* press against the paper, a high intensity electric field is established which draws the toner particles on the tape to the paper. This electric field is established by a voltage supply circuit 34 which is connected between an electrode 36 that lies behind the paper 14, and a metalized layer on the tape. Immediately after the voltage is applied, the actuators release the tape to allow it to draw away from the paper, and the tape region near the transfer station is again accelerated along its path so that another tape portion carrying toner representing another line of characters, can be moved to a position opposite the next line of the paper. It may be noted that the actuators could be placed so that they push tape locations lying beyond the opposite sides of the paper, to the plane of the paper or slightly beyond, but using the paper margins 14*m*** as reference planes provides greater reliability.

The movement of the tape is accomplished by two separate belt transports, including a continuously moving belt transport 40 and an intermittently moving belt transport 42. In addition, a pair of vacuum column buffers 44, 46 such as the type typically used in high speed digital tape recorders, are provided between the two belt transports. The first belt transport 40 includes a belt 48 which moves in a closed path about a drive roller 50 which is driven by a motor 52, and about a series of additional rollers 53, 54 and 55. It may be noted that the magnetic tape 12 and belt 48 separate from one another after passing the roller 54, so that only the magnetic tape passes across the recording head 16 and through the toner device 18. Where a recording head 16 of high resolution is utilized that requires the tape to conform closely to a predetermined curvature, the absence of a belt underneath the tape aids in attaining such curvature. The separation of the belt so it does not pass through the toner device 18, can help reduce the amount of toner that could dirty the belt, although the belt can be passed through the device if good belt cleaning is provided for.

The intermittent belt transport 42 includes another belt 60 which extends about a pair of rollers 62, 64, with one of the rollers driven by a servo motor 66.

A buffer assembly 68, which includes the two vacuum column buffers 44, 46, includes an enclosed region 70 in which a vacuum is maintained, by the pumping out of air through a vacuum coupling 72. It may be noted that the vacuum region 70 is common to both tape columns 74, 76 that lie in the vacuum column buffers. When the tape portion **12*t*, lying at the transfer station is momentarily stopped, tape is fed into the tape column 74, so that it grows longer, while tape is drawn out of the other tape columns so that it grows shorter. The volume of the vacuum region 70 remains constant because as much tape is being fed into one end of this region as is being drawn out of the other end. Thus, only a relatively small vacuum source is required to maintain a relatively constant degree of vacuum in the vacuum region 70. It also may be noted that both belts 48, 60** of the two belt transports pass through the buffer assembly.

The employment of two separate transports 40, 42 enables rapid acceleration and deceleration of tape past the transfer station 20, since only the mass of the intermittently-moving belt 60 and of the tape portion thereon, as well as the equivalent mass of the rollers 62, 64 and motor drive, need to be accelerated and decelerated. In addition, this arrangement enables the tape to move continuously through the toner device 18 and past the head 16, to permit maximum rates of recording and toning and avoid complications that would arise in recording on an intermittently moving tape. The vacuum columns **44*e* and 46*e* must supply appreciable tension to maintain reliable frictional contact between the tape and belts 48 and 60**.

The transfer of toner from the tape portion **12*t* to the paper or other medium 14 by the use of actuators that first move the tape substantially in contact with the paper, has been found to produce a very clear and sharp image on the paper, and with substantially no "background" (stray toner particles). The magnetic tape 12, as best shown in FIG. 3, includes a base 82 of a tough dielectric material such as Mylar, and a layer 84 of magnetizable material on the base. The layer 84** of magnetizable material is of good electrically-conductive material and is therefore formed of metal such as of nickel-cobalt, instead of the more normal oxide materials such as iron oxide. When oxide-type magnetic tape has been utilized in a printer wherein toner is transferred across an air gap of a length of several thousandths inch, as described in U.S. patent application Ser. No. 631,329 filed Nov. 12, 1975, transfer of substantially all toner is effected by an electrostatic field. However, when such oxide-type magnetic tape is utlized in the present system, wherein the tape lies substantially against the paper during toner transfer by an electrostatic field, it has been found that only about 50 percent of the toner is transferred to the paper. It has been found that substantially all of the toner will be transferred from the tape to the paper in the present system, by the use of a magnetic tape with a metalized magnetic layer instead of an oxide layer.

The use of a magnetic tape with a metalized magnetic layer has additional advantages. One advantage is that a high voltage pulse applied between the metalic magnetic layer 84 of the tape and the electrode 36 which lies behind the paper, tends to draw the tape closely against the paper. As a result, good contact between the tape and paper occurs during toner transfer, at all regions of the tape portion **12*t*, even though the tape is pushed down against the paper only at the margin regions 14*m* of the paper by the two plungers 32 of the activators. The two plungers 32 can be formed so they have very low mass, and can be moved by an actuator of very rapid response such as a voice coil type. The need for apparatus to press the entire length of the tape portion 12*t* against the paper is therefore eliminated, and therefore movement of the tape portion 12*t*** against and away from the paper can be accomplished very rapidly.

Instead of utilizing a tape with a metallized layer, it is possible to utilize a metallized layer on the intermittent transport belt 60. Then a tape with a layer of magnetic oxide material can be used, and the electricity source can be connected to the metallic layer on the belt. However, if such an apparatus is utilized, then it would be necessary to take precautions to prevent the toner particles from becoming electrostatically charged which could result in considerable stray particles and therefore the production of background on the paper (i.e. a "dirty" appearance). With a metallized tape, electrostatic charges on toner particles are nearest to minimize background.

In one printing system, the tape portion which extends about the continuously moving belt transport 40, moves at a speed at 50 inches per second, while the tape portion extending about the intermittently moving belt transport 42 moves at a maximum speed of 75 inches per second. The intermittent belt transport 42 stops for a brief period such as 20 milliseconds to effect transfer of toner that represents a line of characters or the like, onto the paper. During such transfer, the activators 28, 30 move locations on the tape 12, approximately 20 thousandths inch so they lie against the margins **14*m* of the paper, and the voltage supply circuit 34 supplies a brief high voltage pulse between the metallized layer on the tape and the electrode 36 which lies behind the paper. The circuit 34 supplies a pulse of an amplitude such as 1200 volts and a duration on the order of magnitude of one millisecond. Thereafter, the circuit 34** supplies a continuous voltage of about 150 volts, which helps to prevent shifting of toner particles on the paper. A transfer pulse which effects transfer of toner to the paper, should be maintained for a period of at least about 0.25 milliseconds to effect transfer of most of the toner. A period of about 1 millisecond has been found sufficient to effect transfer of substantially all of the toner.

FIGS. 4–7 illustrate details of another printing system 100 which is constructed to permit the paper web print medium 102 to move in a largely upward direction from the transfer station 104, and with the recording head 106, upright toning device 108, and buffer assembly 110 located substantially no higher than the transfer station 104. As a result, the upright toning device and other parts of the system do not interfere with reading of lines of characters that have been formed on the paper print medium 102 soon after the paper has passed by the transfer station 104 and a toner fixing station 112. In this system 100, centerline of the tape portion moving along a first transport 111 lies in a substantially horizontal plane, the portion moving along much of the second transport 113 lies in a substantially vertical plane, and the path of the tape includes two approximately 90° twists at 116 and 118. This allows the tape to move downwardly from point 116 so that the recording head 106 and much of the upright toning device 108 can lie below the level of the tape at the transfer station 104. It may be noted in FIG. 5, that the tape 114 and an underlying belt 120 move directly over the plungers 122 of a pair of actuators 124, 126. The plungers 122 are located so that the tape 114 bends in moving around them to assure that the tape portion between the plungers will be fairly taut. Despite this tautness, the belt 120 and tape 114 can still readily be deflected a distance such as 20 thousandths inch in order to move the tape against the web of paper 102. The plungers 122 are spaced from where the tape contacts a pair of rolls 132, 134, which allows the belt and tape to deflect without requiring turning of the rolls 132, 134. It also may be noted that in the particular system 100, both a second belt 130 and the tape 114 move in contact with one another past the recording head 106 and through the toning device 108.

Thus, the invention provides a printing system of the type wherein a magnetized and toned tape or other record is positioned adjacent to a print medium to transfer the toner thereto, wherein the system produces sharply printed characters or the like, with substantially no background, and wherein the system operates at relatively high speed. The system employs a tape or other record with a metal magnetic layer which is moved substantially against the print medium, at which time a brief electric field is established to transfer toner to the print medium. Only a limited number of points along the tape portion, such as two locations near opposite margins of the print medium, need be pressed against the print medium, so that an actuator of minimal mass can be utilized. The tape transport is constructed with two transport portions and with buffers between them, so that a minimum portion of the tape must be accelerated and decelerated, and so that the tape portion which must move across the recording head and through a toning device can move thereat continuously or with only moderate accelerations.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. Printer apparatus for printing on a print medium comprising:

a tape having a layer of magnetizable images on said tape;

a toning device for applying toner to the magnetic images on said tape;

a print medium transport for moving a print medium along a predetermined print medium path that passes adjacent to said tape path at a predetermined transfer location;

transfer means disposed at said transfer location for transferring toner from said tape to said print medium during a time when the tape portion thereat is stationary;

a first transport means for moving said tape substantially continuously along a first tape path portion which extends past said recording head and said toning device;

a second transport means for moving said tape intermittently along a second tape path portion which extends past said transfer location; and first and second buffers disposed between said first and second transport means, said first buffer positioned to receive tape from said first transport means and said second buffer positioned to receive tape from said second transport means.

2. The apparatus described in claim 1 wherein:

said transfer means comprises means for moving a pair of locations along said tape to the plane of said print medium, while leaving the length of tape between said pair of locations free of direct pressure against said print medium, when said second transport is stopped, and means for applying an electric field that extends between said tape and print medium to draw toner from said tape to said print medium.

3. The apparatus described in claim 1 wherein:

said toning device including a quantity of toner and means for guiding said tape along said toner; and said first transport comprises a belt in contact with said tape along most of said first tape path portion, but said belt separating from said tape prior to said tape passing through said toning device so that only said tape passes through said toning device.

4. The apparatus described in claim 1 wherein:

said second transport includes a belt which moves in a closed path with said tape lying over said belt in frictional surface contact therewith over a path portion that includes the portion extending by said transfer location; and said transfer means includes means for pressing said belt toward said print medium, to cause the belt to press the tape thereon against the print medium.

5. The apparatus described in claim 1 wherein:

said second transport includes a belt which moves in a closed path with said tape lying over said belt in frictional surface contact therewith;

said first and second buffers comprise vacuum columns, with said tape extending in loops therein; and said vacuum columns have inner ends closely connected together, and said belt of said second transport passes through said vacuum columns.

6. The printer apparatus described in claim 1 wherein:

said first transport means is constructed to move said tape along a first path portion that passes said recording head and toning device, wherein the centerline of said first portion lying therealong lies in a primarily vertical plane;

said second transport means is constructed to move said tape along a second path portion wherein the centerline of some of the tape portion lying therealong lies in a primarily horizontal plane; and said tape path includes two twisted portions located along said second transport means, whereby the copy sheet can move upwardly, in the conventional manner, and yet the toning device can stand upright.

7. Printer apparatus for printing on a print medium comprising:

a tape having a layer of magnetizeable material thereon, said tape extending in a closed path;

a recording head for recording magnetic images on said tape;

a toning device for applying toner to the magnetic images on said tape;

a print medium transport for moving a print medium along a predetermined print medium path that passes adjacent to said tape path at a predetermined transfer location;

transfer means disposed at said transfer location for transferring toner from said tape to said print medium;

a first transport means for moving said tape substantially continuously along a first tape path portion which extends past said recording head and said toning device;

a second transport means for moving said tape intermittently along a second tape path portion which extends past said transfer location; and a vacuum column buffer having first and second vacuum columns, said tape having a first tape portion between said first and second transports and extending in a loop into said first vacuum column, and said tape having a second tape portion between said second and first transports and extending in a loop into said second vacuum column;

said buffer including a vacuum source coupled to said first and second vacuum columns, and said vacuum columns closely coupled to one another, whereby to avoid large sudden changes in the volume of the vacuum-occupied portions of said vacuum columns.

8. The apparatus described in claim 7 wherein:

at least one of said transports includes a belt, with said tape lying in contact therewith, said belt passing through said vacuum columns.

9. A tape transport apparatus comprising:

a tape for receiving images, said tape extending in a closed path;

a first transport for moving said tape along a first tape portion;

a second transport for moving said tape along a second tape path portion; and first and second buffers disposed between said first and second transport means, said first buffer positioned to receive tape from said first transport means and said second buffer positioned to receive tape from said second transport means;

said second transport comprising a belt extending in a closed path, and said tape lying in frictional contact with said belt between said first and second buffers.

10. The apparatus described in claim 9 wherein:

said buffers comprise vacuum columns having inner ends connected together, and said belt of said second transport passes through said columns.

11. The apparatus described in claim 9 wherein:

said tape extends in a closed loop, and said closed path of said belt lies within the loop of said tape.

* * * * *